United States Patent [19]

Payne

[11] 4,030,268

[45] June 21, 1977

[54] PACKAGING MACHINE

[75] Inventor: Richard Payne, Barton Turf, England

[73] Assignee: Thurne Engineering Company Limited, Norfolk, England

[22] Filed: July 13, 1976

[21] Appl. No.: 704,961

[30] Foreign Application Priority Data

July 18, 1975 United Kingdom ..... 30286/75

[52] U.S. Cl. ..... 53/55; 53/164; 53/244; 53/252

[51] Int. Cl.[2] ..... B65B 57/02; B65B 57/10; B65B 39/12

[58] Field of Search ..... 53/55, 63, 160, 164, 53/235, 240, 244, 252

[56] References Cited

UNITED STATES PATENTS

| | | | |
|---|---|---|---|
| 3,645,064 | 2/1972 | Waite | 53/252 X |
| 3,866,392 | 2/1975 | Weeks et al. | 53/160 |

*Primary Examiner*—Travis S. McGehee
*Attorney, Agent, or Firm*—Larson, Taylor and Hinds

[57] ABSTRACT

A packaging machine for loading trays with delicate articles such as cakes or tarts comprises a first conveyor for conveying a stream of the articles to be loaded, a plate pivotally mounted at the end of a first conveyor to receive articles from the first conveyor, a stop above the plate to locate on the plate an article fed by the first conveyor, a pusher mounted above the plate and on the same side of the stop as the first conveyor, a second conveyor beneath the plate for conveying the tray to be loaded and a mechanism for moving the plate the stop and the pusher. In use the packaging machine is arranged so that articles from the first conveyor move in turn under the pusher and on to the plate where they are located by the stop, the plate is then tipped, the stop moved away from the article and the pusher moved downwards and away from the first conveyor to push the article on the plate down the plate past the stop and off the plate into a tray on the second conveyor. The plate, the stop andthe pusher are subsequently returned to their initial positions to enable the plate to receive a further article from the first conveyor. The machine is usually arranged to accommodate more than one lane of articles on the plate with one article from each lane located on the plate against the stop.

9 Claims, 4 Drawing Figures

PACKAGING MACHINE

This invention relates to machines for handling and packaging delicate articles, particularly foodstuffs, for example cakes and tarts. It is difficult to handle such articles by machinery since the articles are both delicate and fragile and often they are also sticky. Consequently these articles do not slide readily and therefore need positive but gentle handling which is difficult to achieve.

At present, such articles are usually packaged into thin trays moulded from thermoplastics sheet material and these trays are subsequently surrounded by a layer of heat shrinking thermoplastics sheet material which seals the articles into the trays. At present the articles are loaded into the trays entirely by hand which is both time consuming and extremely tedious for the operator carrying out the loading operation.

According to this invention a packaging machine for loading trays with articles such as cakes or tarts comprises a first conveyor for conveying a stream of the articles to be loaded, a plate pivotally mounted at the end of the first conveyor to receive articles from the first conveyor, a stop above the plate to locate on the plate an article fed by the conveyor, a pusher mounted above the plate and on the same side of the stop as the first conveyor, a second conveyor beneath the plate for conveying the trays to be loaded, and a mechanism for moving the plate, the stop and the pusher so that, in use, articles from the first conveyor move to turn under the pusher and on to the plate where they are located by the stop, the plate then being tipped, the stop being moved away from the article and the pusher being moved downwards and away from the first conveyor to push the article on the plate down the plate past the stop and off the plate into a tray on the second conveyor, the plate, the stop and the pusher subsequently being returned to their initial positions to enable the plate to receive a further article from the first conveyor.

Preferably the plate is arranged so that when it is tipped its edge facing towards the first conveyor moves into the path of the articles moving from the first conveyor on to the plate so that, in use, the edge of the plate stops the following article from moving on to the plate until the plate has returned to its initial position. The second conveyor may move stepwise but preferably the second conveyor moves continuously. The combination of the plate, the stop and the pusher ensures that the timing of the movement of the article as it moves from the plate into a tray on the second conveyor is regular and thus enables this machine to include a continuously moving second conveyor which speeds the operation of the machine.

In practice the first conveyor will usually convey several lanes of articles and one article from each lane will be located on the plate against the stop. The mechanism for moving the plate, the stop and the pusher is preferably driven directly from the second conveyor so that the movement of the mechanism is always synchronised with the movement of the second conveyor and the trays. Preferably the machine includes an override control which prevents the mechanism operating when either there is not an article from each lane on the plate, or there is no tray on the second conveyor. The first conveyor may be a smooth surfaced belt conveyor which is arranged to move continuously and slip beneath each lane of articles when the first of the articles in each lane is located against the stop. When the articles being handled are particularly delicate and would be damaged by the drag exerted by the belt against their bases the first conveyor may move intermittently in synchronism with the mechanism for moving the plate, the stop and the pusher.

Frequently more than one layer of articles are packed in each tray and in this case at least two machines in accordance with this invention are arranged generally side by side, and means is provided for moving trays transversely from the loading position of the first machine to the loading position of the next machine. Two layer packs are produced by arranging the mechanisms of the machines so that each tray receives a first layer of articles from the first machine and, after being moved transversely, receives a second layer from the second machine. However, single layer packs may still be produced if desired, by arranging the mechanisms so that alternate trays receive a layer of articles from the first machine and the intervening trays, which are empty on leaving the first machine, receive a layer of articles from the second machine. This arrangement of two or more machines side-by-side is particularly useful with cakes and tarts since these are usually made by a machine which forms several lanes all at the same time and then feeds them away from the machine on a cooling band.

An example of an apparatus for loading two layers of tarts into trays will now be described with reference to the accompanying drawings, in which.

Figure 1:
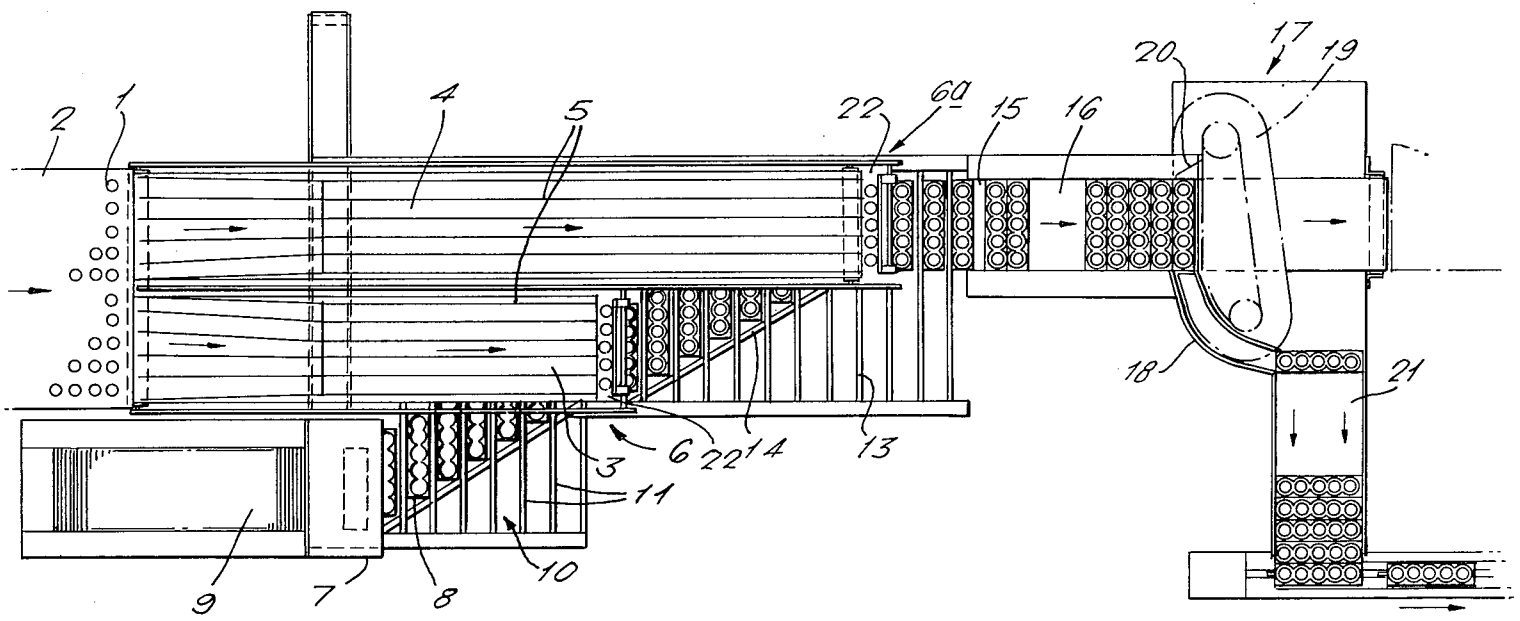
FIG. 1 is a plan view of the complete apparatus.

Tarts 1 are arranged in lines on a cooling band 2 leading away from a tart making machine (not shown). At the end of the cooling band 2 the tarts 1 are separated into two streams and fed onto belt conveyors 3 and 4 each of which is equipped with longitudinal guides 5 separating the individual lines of tarts into lanes. At the down stream end of each of the belts 3 and 4 are portions of the apparatus 6 and **6*a* which load the tarts. These parts 6 and 6*a* will be described in detail with reference to FIGS. 2, 3 and 4 of the drawings. A tray depositor 7 separates individual trays 8 from a horizontal stack of trays 9 and places them one at a time on to a conveyor 10. The tray depositor 7 includes suction heads (not shown) which engage the leading tray in the stack 9** and pull it away from the stack, the suction heads subsequently being moved through a right angle before the trays are released.

The conveyor 10 includes a series of transverse flights 11 which divide the conveyor into separate segments. One tray 8 is placed into each segment between each pair of adjacent flights 11. A curve 12 which is loaded is located between the flights and the belts of the conveyor 10 bears against the trays 8 and moves them transversely across the conveyor 10 until they are aligned with and beneath the belt conveyor 3.

The trays are passed from the conveyor 10 to another conveyor 13 which is similar in construction to the conveyor 10. A layer of tarts is loaded into each of the trays on the conveyor 13 by the portion 6 of the apparatus and this operation will be described in detail subsequently. The part filled trays 8 are then moved along the conveyor 13 and again moved transversely by a further curve 14 until they are aligned with and beneath the belt conveyor 4. A second layer of tarts then placed in each tray by the portion 6a and then the filled trays are fed from the conveyor 13 on to a deadplate 15. The filled trays are pushed across the deadplate 15 by following trays and on to a belt conveyor 16 which feeds a transfer unit 17 having a curved guide 18 and an endless belt 19 with spaced flanges 20 outstanding from it. The flanges 20 move each filled tray in succession along the curved guide 18 and on to a further belt conveyor 21. The trays are subsequently taken from the conveyor 21 to a sealing machine where a tubular shrink wrapping is placed over the filled trays to seal them.

Figure 2:
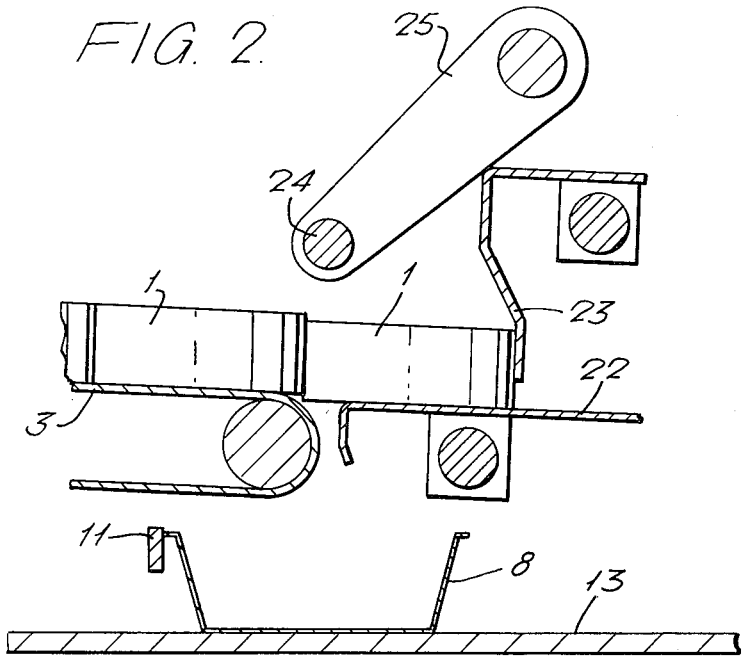
FIG. 2 is a vertical section through a loading part of the apparatus in the first position.
Figure 3:
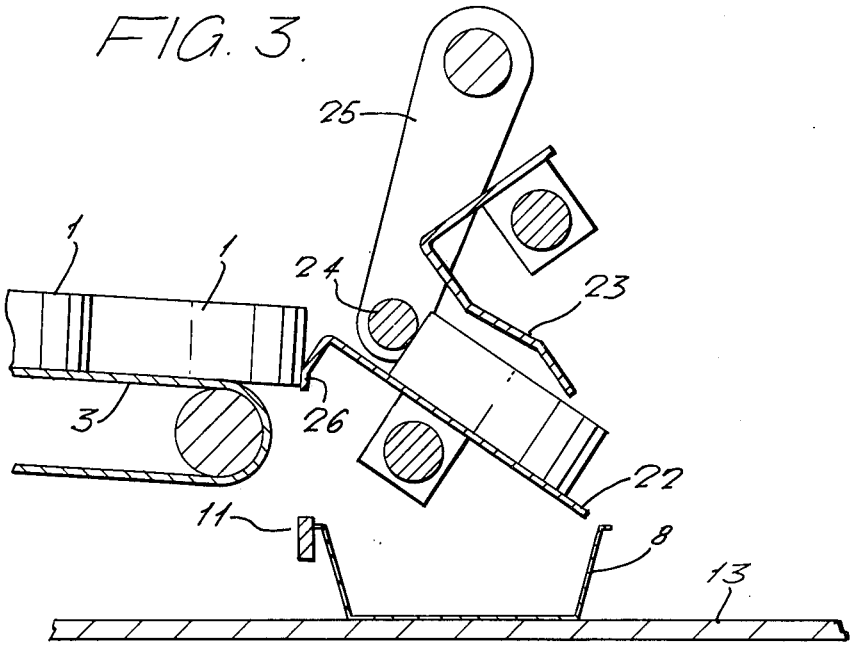
FIG. 3 is a similar view to FIG. 2 but showing the loading part of the apparatus in the second position; and, FIG. 4 shows an operating mechanism of the tower loading part of the apparatus.

The tray loading portions of the apparatus 6 and 6a are identical and one of these, the portion 6, is shown more clearly in FIGS. 2, 3 and 4 and will now be described in detail.

The belt conveyor 3 feeds the tarts 1 on to a plate 22 which is pivotally journalled through a main frame of the apparatus. A stop 23 which is also pivotally journalled in the main frame is mounted above the plate 22 and prevents the tarts 1 moving across the plate 22. A pusher bar 24 which is mounted on a pair of arms 25 is also pivotally journalled in the main frame. The pusher bar 22 is positioned above the part of the tarts 1 and upstream from the stop 23. The belt conveyor 3 may move continuously when the tarts 1 are robust but preferably the belt conveyor 3 moves intermittently but moves far enough to urge the foremost tart 1 in each lane on to the plate 22 until it abuts the stop 23 and then any further movement of the belt 3 merely cause a slip between the belt and the base of the tarts in that lane.

To load the tarts on the plate 22 into the trays 8 which are located on the conveyor 13 beneath the plates 22 the plate 22 is tipped, the stop 23 is pivoted and the arms 25 are pivoted to move the pusher bar 24 forwards. With the plate 22 tilted and the stop 23 pivoted there is sufficient clearance between the stop 23 and the plate 22 to enable the tart 1 present on the plate 22 to move between the stop 23 and the plate 22. The pusher bar 24 moving forwards from behind the tart 1 pushes the tart 1 down the plate 22 and this is the position shown in the FIG. 3. This positive feed of the tarts 1 down the pivoted plate 22 and into the trays 8 leads to a great advantage since the tarts are positively fed down the plate 22 by the movement of the pusher bar 24 and this means that the moment at which the tarts leave the plate 22 and drop into the trays 8 can be predicted with great accuracy. Thus the conveyor 13 may move continuously and this speeds up the operation of the whole machine. Further the tarts are sometimes sticky and consequently the positive, but gentle feed provided by the pusher bar 24 ensures that they move down the tipped plate 22 at the same time irrespective of the adhesion of the tarts to the plate 22.

The upstream edge of the plate 22, that is the edge facing the conveyor 3, includes a downturned lip 26 which acts as a stop when the plate 22 is tipped to prevent further tarts from the conveyor 3 from moving on to the plate 22. After the tarts have been loaded into the trays 8 the plate 22, the stop 23 and the arms 25 together with the pusher bar 24 return to their initial positions and allow the following tart in each of the lanes to move on to the plate 22 to abut the stop 21.

Figure 4:
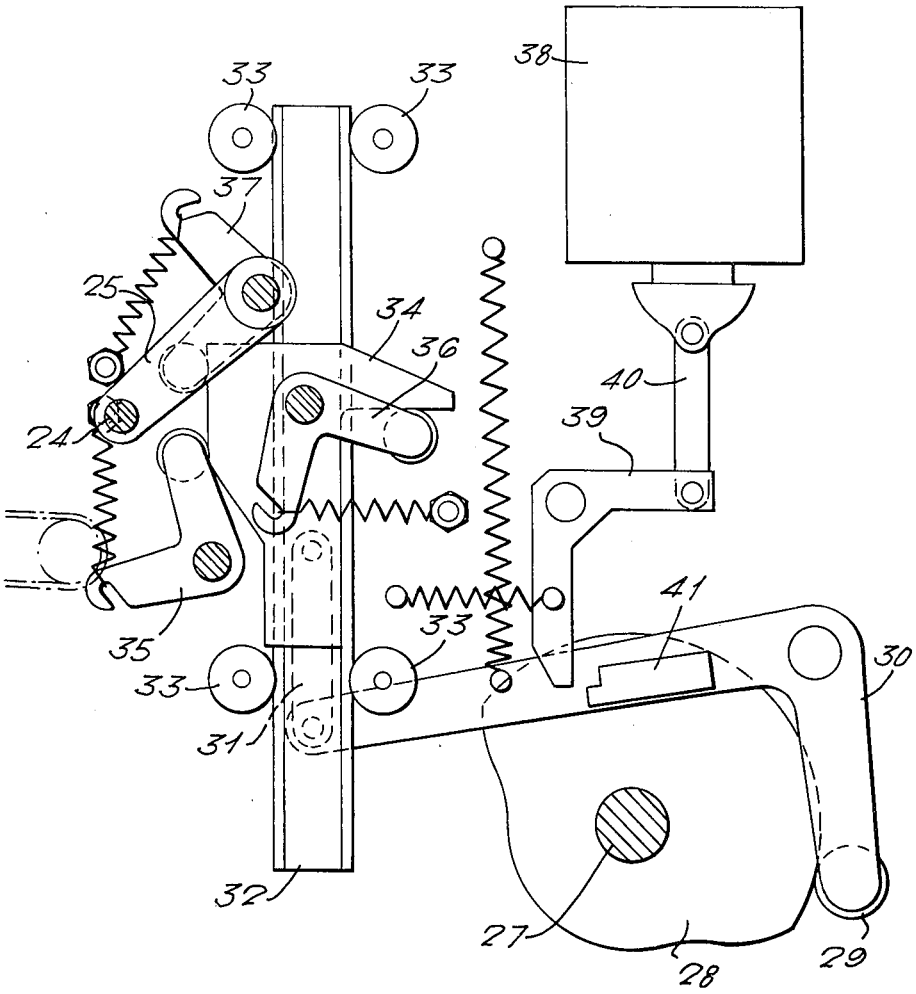

The movements of the plate 22, the stop 23 and the pusher bar 24 are governed by an operating mechanism which is shown in FIG. 4. This mechanism is driven from a rotary shaft 27 on which is mounted a cam 28. The shaft 27 is part of the drive for the conveyor 13 and consequently once the angular position of the cam 28 on the shaft 27 has been set the timing of the operation of the mechanism in relation to the location of the trays 8 on the conveyor 13 is maintained constant.

A cam follower 29 at one end of a pivoted bellcrank 30 bears on the cam 28 whilst the other end of the bellcrank 30 is connected through a link 31 to an upright bar 32. The bar 32 has a knife-edge down each of its sides and is supported by two pairs of grooved rolls 33. The bar 32 carries a cam plate 34 and this cam plate 34 controls the movement of bellcranks 35, 36 and 37 which are connected to the plate 22, the stop 23 and the arms 25 resepectively. Each bellcrank operates against the bias of a spring which urges a cam follower on one end of each of the bellcranks against the cam plate 32. The mechanism is supported by the main frame of the apparatus and this main frame has been omitted from the drawings for clarity.

Photocells (not shown) are provided to ensure that a tart from each lane is present on the plate 22 and also that a tray 8 is located beneath the plate 22 ready to receive the tarts. If these photocells show that either of these conditions has not been met in that a tart is absent from the plate 22 or that a tray is absent from the conveyor 13 then a solenoid 38 is operated and this solenoid moves a bellcrank 39 through a pivoted link 40. When the solenoid is operated the free end of the bellcrank 39 moves into contact with an abutment 41 fixed to the bellcrank 30. When the free end of the bellcrank 39 is in contact with the abutment 41 it prevents the cam follower 29 following the profile of the cam 28 and thus prevents it operating the tray loading device. Thus, unless there is a tart from each lane on the plate 22 and a tray beneath the plate 22 ready to receive the tarts, the tart loading device is prevented from operating.

I claim:

1. A packaging machine for loading trays with articles comprising, a first conveyor means for conveying a stream of articles to be loaded, a plate for receiving articles from said first conveyor, means pivotally mounting said plate at the end of said first conveyor means, a stop to locate on said plate articles from said first conveyor means, means mounting said stop above said plate, a pusher to push articles present on said plate, means mounting said pusher above said plate and on the same side of said stop as said first conveyor means, a second conveyor means beneath said plate for conveying trays to be loaded, and a mechanism coupled to said plate, said stop and said pusher whereby actuation of said mechanism causes said plate to be tipped, said stop to be moved away from said article and said pusher to be moved downwards and away from said first conveyor means to push said article present on said plate down said plate past said stop and off said plate into said tray on said second conveyor means, further actuation of said mechanism causing subsequent return of said plate, said stop and said pusher to their initial positions to enable said plate to receive a further article from said first conveyor means.

2. The packaging machine of claim 1, wherein said plate includes stop means arranged so that when said plate is tipped said stop means face said first conveyor means and move into the path of said articles moving from said first conveyor means on to said plate whereby said stop means prevents said further article from moving on to said plate and returns to its initial position.

3. The packagng machine of claim 1, wherein said second conveyor means includes drive means capable of moving said second conveyor means continuously.

4. The packaging machine of claim 1, wherein said first conveyor means is adapted to convey more than one lane of said articles on to said plate with one article from each of said lanes being located on said plate by said stop.

5. The packaging machine of claim 3, wherein said mechanism for moving said plate, said stop and said pusher is driven from said drive and said second conveyor means whereby said actuation of said mechanism is maintained in synchronism with movement of said second conveyor means.

6. The packaging machine of claim 1 including override control means coupled to said mechanism to prevent said mechanism operating when a tray is absent from said second conveyor means.

7. The packaging machine of claim 1, including override control means coupled to said mechanism to prevent said mechanism operating when an article is absent from said first conveyor means.

8. A packaging apparatus comprising at least two machines in accordance with claim 1, arranged generally side by side, and translational means for moving said trays transversely from a first of said machines to a second of said machines, said mechanisms of said machines being operative whereby each of said trays receives a first layer of articles from said first machine and, after being moved transversely by said translational means, receives a second layer of articles from said second machine, 9. A packaging apparatus comprising at least two machines in accordance with claim 1, arranged generally side by side, and translational means for moving said trays transversely from a first of said machines to a second of said machines, said mechanisms of said machines being operative, whereby alternate ones of said trays receive a layer of articles from said first machine and, after said trays have been moved transversely by said translational means, the intervening ones of said trays, which are empty on leaving said first machine, receive a layer of articles from said second machine.

* * * * *